US010182650B1

(12) United States Patent
Schenker et al.

(10) Patent No.: US 10,182,650 B1
(45) Date of Patent: Jan. 22, 2019

(54) ONE PIECE COLLAPSIBLE SHELVING UNIT WITH VERTICAL DIVIDER STRUCTURE

(71) Applicant: Advantus, Corp., Jacksonville, FL (US)

(72) Inventors: David A. Schenker, Cedarburg, WI (US); Chris Pitzo, Pewaukee, WI (US)

(73) Assignee: Advantus, Corp., Jacksonville, FL (US)

( * ) Notice: Subject to any disclaimer, the term of this patent is extended or adjusted under 35 U.S.C. 154(b) by 0 days.

(21) Appl. No.: 15/715,855

(22) Filed: Sep. 26, 2017

(51) Int. Cl.

| | |
|---|---|
| ***A47F 5/10*** | (2006.01) |
| ***A47F 5/13*** | (2006.01) |
| ***A47B 55/02*** | (2006.01) |
| ***A47B 43/00*** | (2006.01) |
| ***A47B 96/04*** | (2006.01) |

(52) U.S. Cl.
CPC ..... *A47B 43/00* (2013.01); *A47B 55/02* (2013.01); *A47B 96/04* (2013.01); *A47F 5/13* (2013.01)

(58) Field of Classification Search
CPC ... A47F 5/10; A47F 5/13; A47F 5/137; A47B 43/00; A47B 47/00; A47B 47/0058; A47B 1/05; A47B 55/02; A47B 96/021
See application file for complete search history.

(56) References Cited

U.S. PATENT DOCUMENTS

| | | | | |
|---|---|---|---|---|
| 915,618 A | | 3/1909 | Mattison | |
| 1,602,410 A | | 10/1926 | Hamblin | |
| 2,680,522 A | * | 6/1954 | Temple | A47F 5/13 108/59 |
| 3,252,434 A | * | 5/1966 | Young, Jr. | A47F 5/13 108/181 |
| 3,527,174 A | * | 9/1970 | Lay | A47B 31/04 108/115 |
| 3,840,243 A | | 10/1974 | Rheinhart et al. | |
| 3,977,689 A | | 8/1976 | Rosa | |
| 3,981,510 A | * | 9/1976 | Gustafsson | B62B 3/186 280/33.996 |
| 4,077,522 A | * | 3/1978 | Trubiano | A47F 5/13 211/175 |
| 4,322,005 A | | 3/1982 | Robertson | |

(Continued)

*Primary Examiner* — Kimberley S Wright

(74) *Attorney, Agent, or Firm* — Andrus Intellectual Property Law, LLP

(57) ABSTRACT

A shelving unit movable between a shelf-supporting condition and a collapsed condition includes first and second side support frames pivotally connected to a rear support frame. At least two shelves are pivotally mounted to the rear support frame for movement between a horizontal position supported on the first and second side support frames, and a vertical position removed from the first and second side support frames. At least one divider is pivotally mounted to one of the at least two shelves between a vertical position between the at least two shelves and a horizontal position folded against the one of the least two shelves. The first and second side support frames are folded forwardly of the at least two shelves in the vertical position thereof, and the second side support frame is also folded forwardly of the at least one divider folded against the one of the at least two shelves to form a compact folded, layered arrangement so that the shelving unit is easy to store and transport.

20 Claims, 9 Drawing Sheets

(56) References Cited

U.S. PATENT DOCUMENTS

| | | | | | |
|---|---|---|---|---|---|
| 4,546,887 | A * | 10/1985 | Cohn | A47B 73/002 211/49.1 |
| 4,595,106 | A * | 6/1986 | Kunze | B65G 9/002 211/118 |
| 4,978,013 | A * | 12/1990 | Hogg | A47F 5/13 211/132.1 |
| 5,882,098 | A | 3/1999 | Brown et al. | |
| 6,994,034 | B2 * | 2/2006 | Chang | A47B 21/00 108/115 |
| D547,093 | S * | 7/2007 | Butters | D6/566 |
| 7,832,571 | B2 | 11/2010 | Felsenthal | |
| 9,144,332 | B2 | 9/2015 | Lim | |
| 9,247,809 | B1 | 2/2016 | Hsu | |
| 9,282,820 | B2 | 3/2016 | Lo | |
| 9,901,169 | B1 * | 2/2018 | Schenker | A47B 43/00 |
| 2003/0057171 | A1 | 3/2003 | Wang | |
| 2011/0031200 | A1 * | 2/2011 | Chen | A47B 43/00 211/149 |
| 2018/0168306 | A1 * | 6/2018 | Shyr | A45C 13/02 |

* cited by examiner

ONE PIECE COLLAPSIBLE SHELVING UNIT WITH VERTICAL DIVIDER STRUCTURE

FIELD

The present disclosure relates generally to article holding racks or shelving units and, more particularly, pertains to shelving units which are preassembled, collapsible and utilized to support and store a variety of goods.

BACKGROUND

Article holding racks or shelving units are commonly used by people in homes, schools and workplaces to hold various articles, such as books and magazines, plants, small appliances, knick-knacks, clothes and other personal items. Many of these units are designed to be folded or disassembled to reduce size and profile for storage. Unfortunately, many of these known units remain difficult to fold or assemble and disassemble such that storage and setup can be inconvenient. In this regard, the construction of a number of these units is rather complex, leading to increased cost of production or inconvenience to the user.

It remains desirable to provide a preassembled, one piece shelving unit which can be simply and quickly unfolded to a shelf-supporting position, and folded to a collapsed position to enable ease of storage and transport.

SUMMARY

In one example, a shelving unit includes a rear support frame having a pair of vertical side members, and a set of horizontal members extending between the vertical side members. A first side support frame is pivotally connected to one of the vertical side members of the rear support frame. A second side support frame is pivotally connected to the other of the vertical side members. At least two shelves are provided and are pivotally mounted to the rear support frame for movement between a horizontal position supported upon the first and second side support frames, and a vertical position removed from the first and second side support frames. At least one divider is pivotally mounted to one of the at least two shelves for movement between a first position extending between the at least two shelves, and a second position folded against the one of the at least two shelves, the at least one divider being movable in the second position thereof with the one of the at least two shelves to the vertical position thereof. One of the first and second side support frames is pivoted between a first position extending forwardly from the rear support frame, and a second position folded forwardly of the rear support frame and the at least two shelves in the vertical position thereof. The other of the first and second side support frames is pivoted between a first position extending forwardly from the rear support frame, and a second position folded forwardly of the rear support frame and the at least two shelves in the vertical position thereof and the at least one divider in the second position thereof.

In another example, a shelving unit includes a rear support frame having a pair of vertical side members, and a set of horizontal members extending between the vertical side members. A first side support frame is pivotally connected to one of the vertical side members of the rear support frame. A second side support frame is pivotally connected to the other of the vertical side members. At least two shelves are pivotally mounted to the rear support frame for movement between a horizontal position supported upon the first and second side support frames, and a vertical position removed from the first and second side support frames. At least one divider is pivotally mounted to one of the at least two shelves for movement between a first position extending between the at least two shelves, and the second position folded against the one of the at least two shelves, the at least one divider being movable in the second position thereof with the one of the at least two shelves to the vertical position thereof. One of the first and second side support frames is pivoted between a first position extending forwardly from the rear support frame, and a second position folded forwardly of the rear support frame and the at least two shelves in the vertical position thereof. The other of the first and second side support frames is pivoted between a first position extending forwardly from the rear support frame, and a second position folded forwardly of the rear support frame and the at least two shelves in the vertical position thereof and the at least one divider in the second position thereof. The at least one divider includes a movable clip arrangement configured for engagement and disengagement with the at least one of the at least two shelves.

In a further example, a shelving unit includes a rear support frame having a pair of vertical side members, and a set of horizontal members extending between the vertical side members. A first side support frame is pivotally connected to one of the vertical side members of the rear support frame, and provided with a first shelf-supporting structure. A second side support frame is pivotally connected to the other of the vertical side members of the rear support frame, and provided with a second shelf-supporting structure. A first shelf is pivotally mounted between the vertical side members for movement between a horizontal position supported on the first and second shelf-supporting structure, and a vertical position removed from the first and second shelf-supporting structure and received between the vertical side members. A second shelf is pivotally mounted between the vertical side members for movement between a horizontal position supported on the first and second shelf-supporting structure above the first shelf in the horizontal position thereof, and a vertical position removed from the first and second shelf-supporting structure, and received between the vertical side members. A third shelf is pivotally connected between the vertical side members for movement between a horizontal position supported on the first and second shelf-supporting structure above the second shelf in the horizontal position thereof, and a vertical position removed from the first and second shelf-supporting structure and positioned forwardly of and against the second shelf in the vertical position thereof. A first divider is pivotally mounted to the second shelf for movement between a first position extending between the first and second shelves, and a second position folded against the second shelf, the first divider being movable in the second position thereof with the second shelf to the vertical position thereof. A second divider is pivotally mounted to the third shelf for movement between a first position extending between the second and third shelves, and a second position folded against the third shelf, the second divider being movable in the second position thereof with the third shelf to the vertical position thereof. One of the first and second side support frames is pivoted between a first position extending forwardly from the rear support frame, and a second position folded forwardly of the rear support frame and the first, second and third shelves in the vertical position thereof. The other of the first and second side support frames is pivoted between a first position extending forwardly from the rear support frame, and a second position folded forwardly of the rear support frame, the first, second and third shelves in the vertical position thereof and the first and second dividers in the second positions thereof.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION

Figure 2:
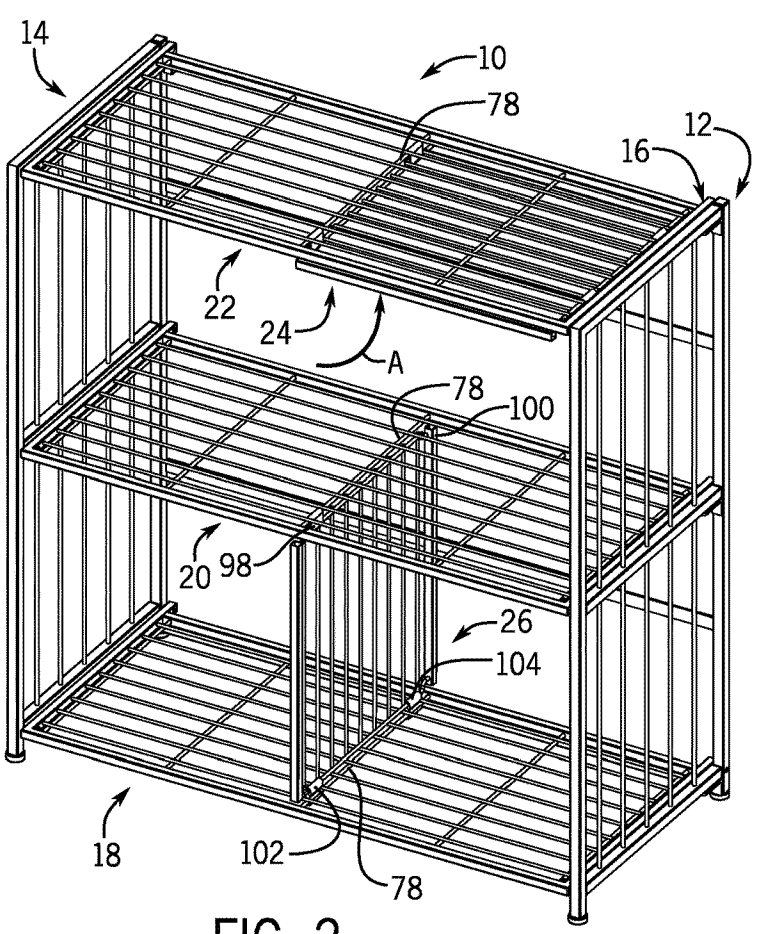
FIG. 2 is a front perspective view depicting a first stage of the shelving unit of FIG. 1 being folded towards a collapsed condition.

A one piece, preassembled collapsible shelving unit 10 of the present disclosure is variously illustrated in FIGS. 1-14. An exemplary embodiment of the shelving unit 10 is generally comprised of a rear support frame 12, a movably mounted left side support frame 14, a movably mounted right side support frame 16, a plurality of movably mounted shelves, including a bottom shelf 18, a middle shelf 20 and a top shelf 22, and a pair of movably mounted upper and lower dividers 24, 26.

In the example illustrated, the shelving unit 10 is provided with three shelves and two dividers, but it should be understood that the shelving unit 10 can be constructed with at least two shelves and at least one divider in alternate configurations contemplated by the present disclosure. As seen in the drawings, the shelving unit 10 is variously configured between a shelf-supporting condition (FIG. 1) used to support and hold a variety of items, and a collapsed condition (FIGS. 11 and 12) which allows for convenient transport and stowage of the shelving unit 10.

Figure 4:
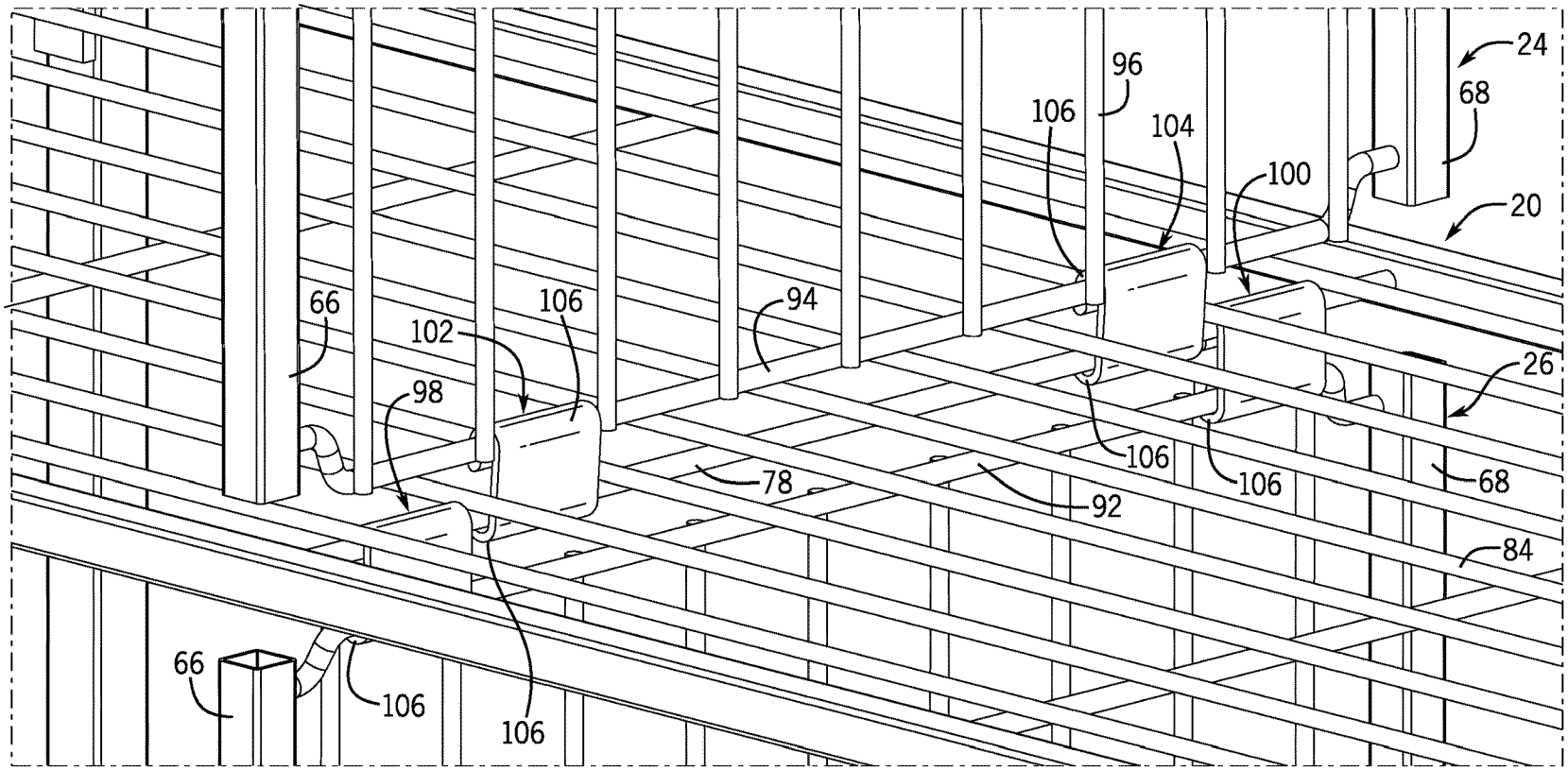
FIG. 4 is an enlarged fragmentary detail view of clips and dividers used on the shelving unit shown in FIG. 1.
Figure 5:
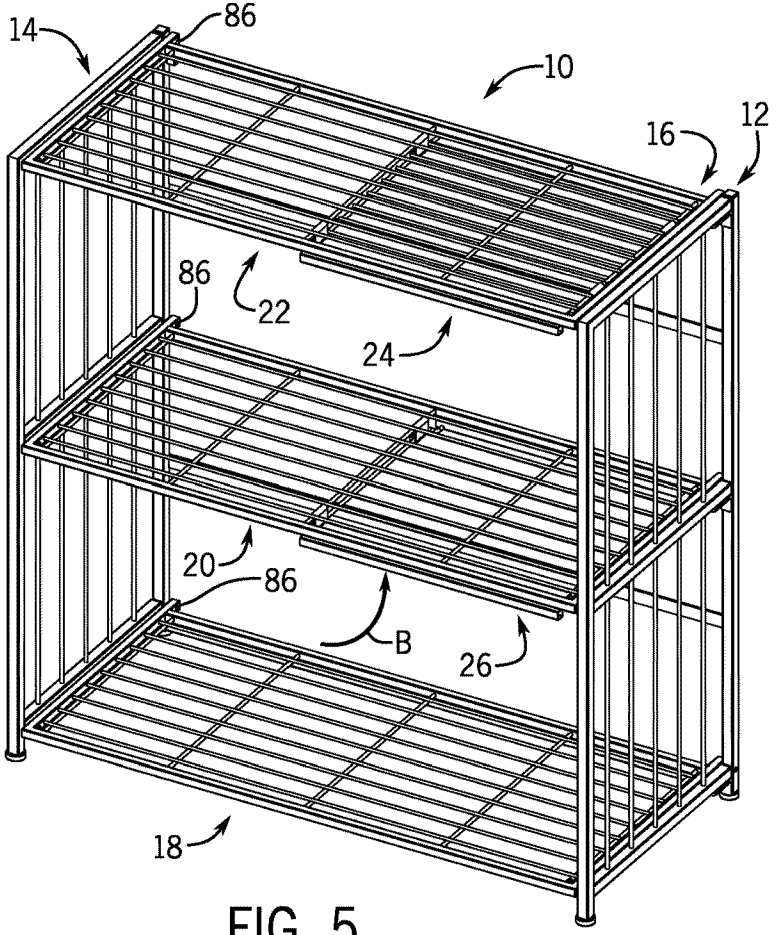

As seen best in FIGS. 4 and 5, the rear support frame 12 has a pair of opposing vertical side members 28, 30, respectively, and a series of horizontal cross members including a lower horizontal cross member 32, an intermediate horizontal cross member 34 and an upper horizontal cross member 36 extending between the vertical side members 28, 30 to provide a rigid rear support structure.

Figure 10:
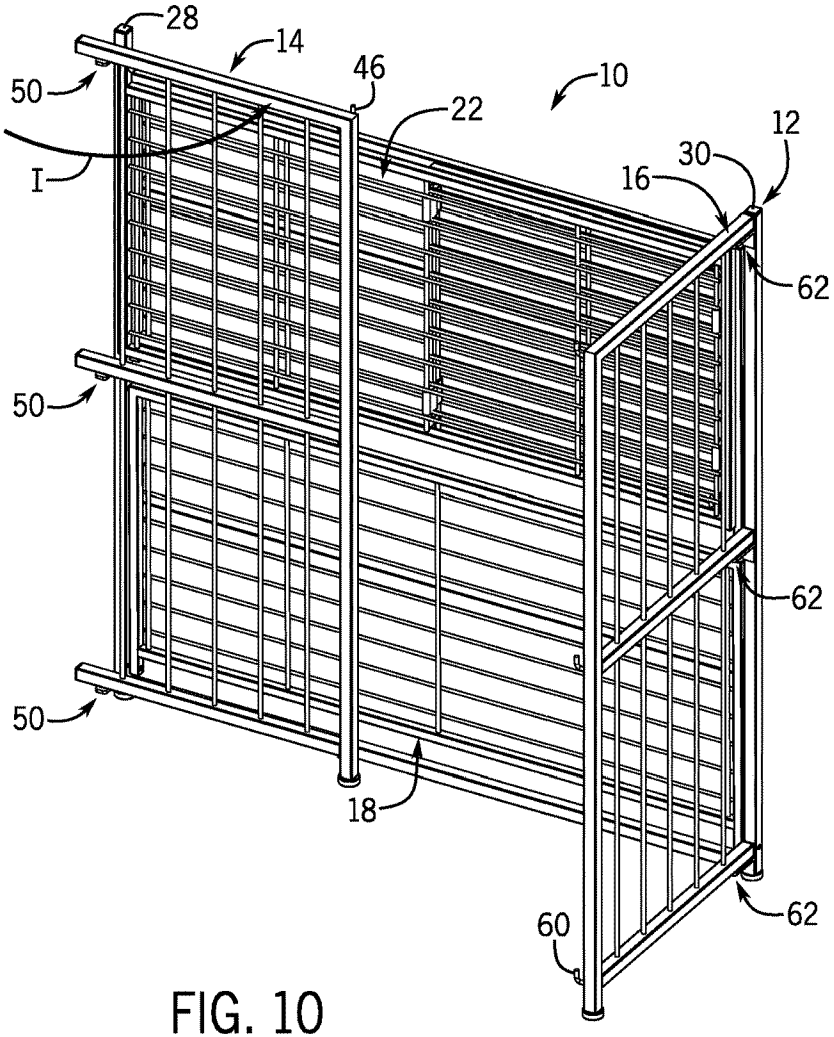
Figure 12:
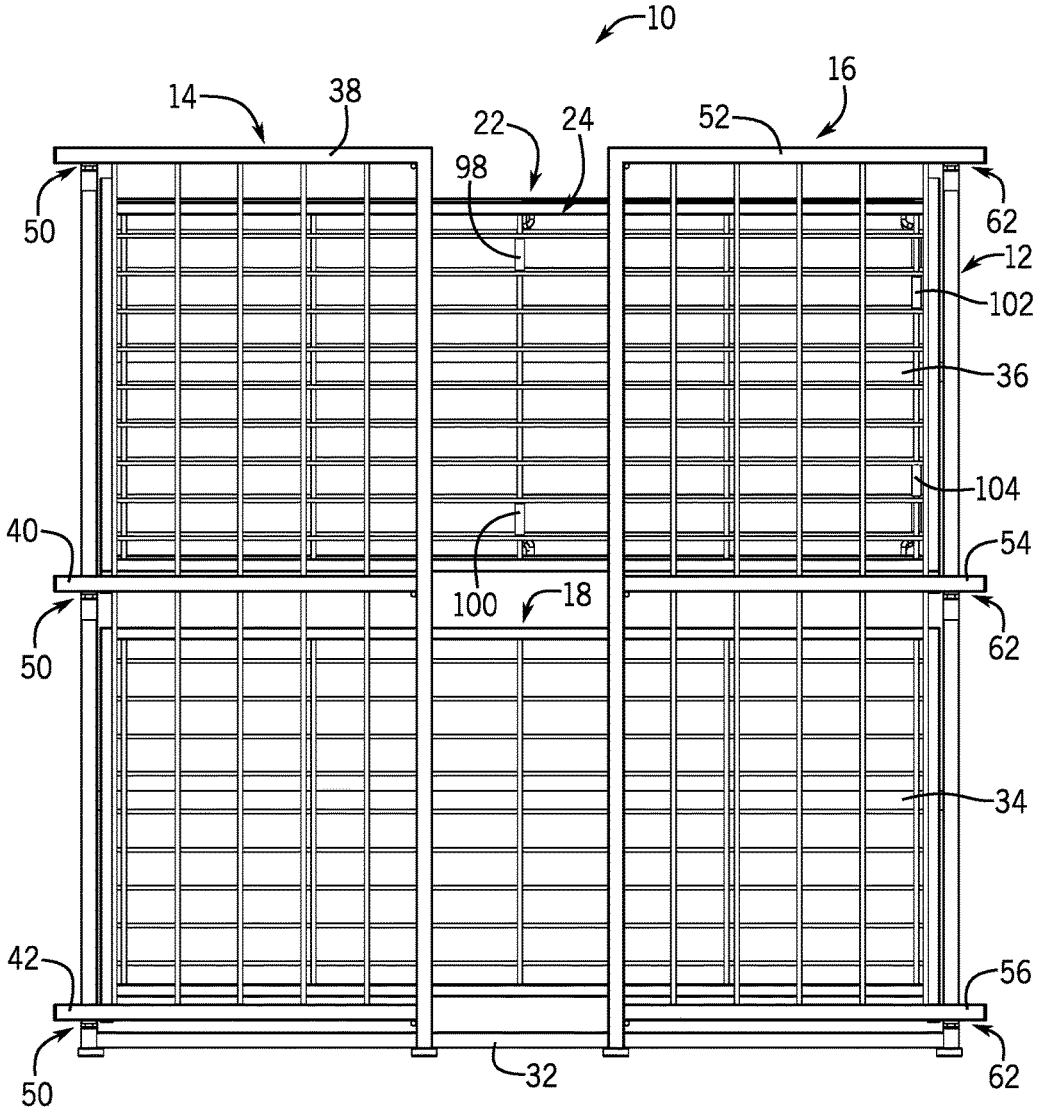
FIG. 12 is a front view of the shelving unit in the collapsed condition.
Figure 14:
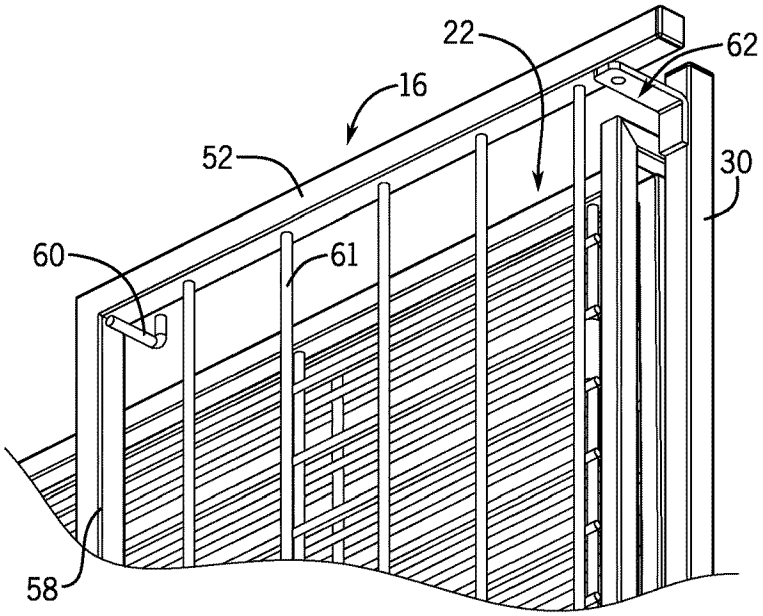
FIGS. 13 and 14 are enlarged fragmentary detail views showing a pivotal connection used in the folding of the shelving unit towards the collapsed condition.

The left side support frame 14 has an upper horizontal member 38, an intermediate horizontal member 40 and a lower horizontal member 42, each of which has a forward end fixed to a vertical front member 44. A rear face of the vertical front member 44 provides a mounting surface to which three spaced apart inwardly and upwardly extending shelf-supporting hooks 46 (FIG. 8) are fixed. A plurality of vertical wire rods 48 extend between the upper and lower horizontal members 38, 42 and pass through the vertical horizontal member 40. Rearward ends of the upper, intermediate and lower horizontal members 38, 40, 42, respectively, are each pivotally mounted to the vertical member 28 of the rear support frame 12 by a first pivotal connection 50 (FIGS. 10 and 12). The first pivotal connection 50 will be described in more detail in connection with the description of a similar pivotal connection employed on the right side support frame 16 as set forth below.

The right side support frame 16 has an upper horizontal member 52, and intermediate horizontal member 54, and a lower horizontal member 56, each of which has a forward end fixed to a vertical front member 58. A rear face of the vertical front member 58 serves as a mounting surface to which three spaced apart inwardly and upwardly extending shelf-supporting hooks 60 (FIG. 8) are fixed. A plurality of vertical wire rods 61 extend between the upper and lower horizontal members 52, 56, respectively, and pass through the intermediate horizontal member 54. Rearward ends of the upper, intermediate and lower horizontal members 52, 54, 56, respectively, are each pivotally mounted to the vertical side member 26 by a second pivotal connection 62 (FIGS. 10 and 12).

Figure 13:
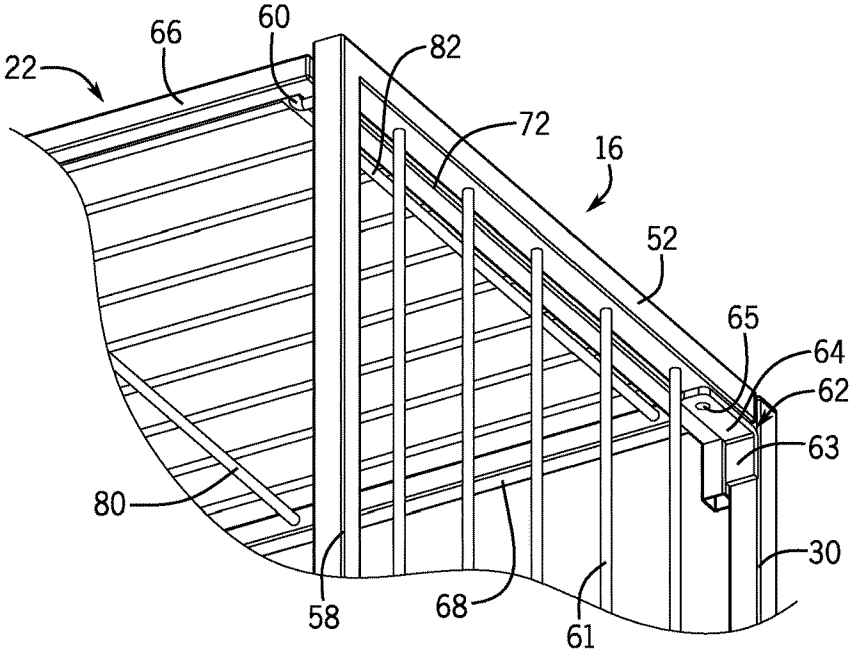

With further reference to FIG. 13, each of the three pivotal connections 62 is defined by a rigid L-shaped support bracket having a vertical leg 63 integrally joined to a forwardly extending horizontal leg 64. Each vertical leg 63 is fixed to a front surface of the vertical member 30 beneath each of the horizontal members 52, 54, 56. Each horizontal leg 64 has an outer end which is attached by a pivot pin 65 to an underside of the horizontal members 52, 54, 56 at a location spaced forwardly from a rearmost end of each of the horizontal members 52, 54, 56. The pivotal connections 62 enable the right side support frame 16 to be pivotally mounted about a vertical axis to the vertical side member 30. The first pivotal connections 50 enabling pivoting of the left side support frame 14 relative to vertical member 28 are similarly constructed like the second pivotal connections 62. The pivotal connections 50, 62 permit the left side and the right side support frames 14, 16 to be pivoted towards each other to a spaced apart arrangement which results when the shelving unit 10 is folded towards the collapsed condition as will be described hereafter.

Each of the shelves 18, 20, 22 has an identical construction, and includes a front rail 66, a rear rail 68 and opposed side rails 70, 72 which together form a rectangular shelf frame. Wire support rods 74, 76, 78, 80, 82 extend between each front rail 66 and each rear rail 68, and support rods 84 extend transversely across the wire rods 74, 76, 78, 80, 82 and longitudinally between the opposed side rails 70, 72 to form a planar support structure. Rearward outer corners of the shelves 18, 20, 22 are pivotally mounted by a third set of pivotal connections 86, such as provided on shelves 18, 20, 22 in FIGS. 5-8 to inside surfaces of the vertical members 28, 30 to enable each of the shelves 18, 20, 22 to swing about a separate horizontal pivot axis. Each of the shelves 18, 20 is configured to pivot between a horizontal position (e.g. FIGS. 1 and 2) and a vertical raised position (e.g. FIGS. 6 and 7). The shelf 22 is configured to pivot between a horizontal position (e.g. FIGS. 1, 2, 5, 6) and a vertical lowered position (e.g. FIGS. 9-11).

Figure 1:
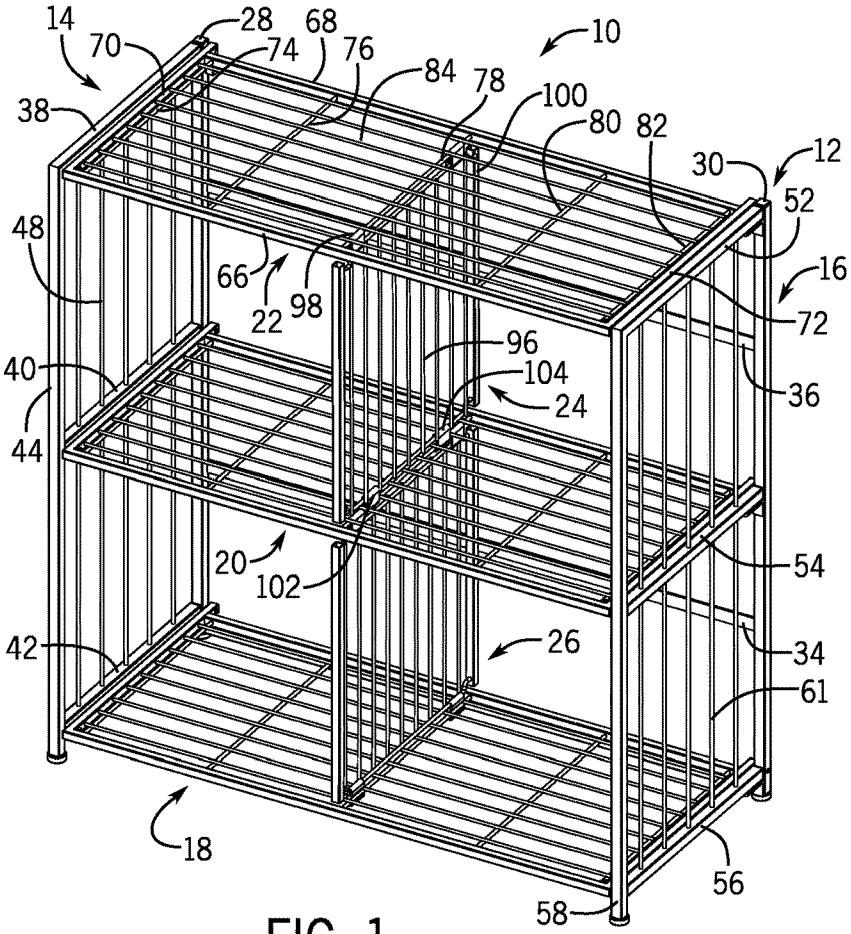
FIG. 1 is a front perspective view of a one piece collapsible shelving unit in accordance with the present disclosure, and shown in an unfolded shelf-supporting condition.

In the horizontal position shown in FIG. 1, the side rails 70, 72 of the shelves 18, 20, 22 are supported by the hooks 46, 60 provided on the opposed front members 44, 58, respectively. In the vertical raised position, the shelves 18, 20 are sized to be completely received between the vertical side members 28, 30, and are limited in travel rearwardly of the shelving unit 10 by the cross members 34, 36. In the vertical lowered position, the shelf 22 is positioned forwardly of the raised shelf 20 in parallel relation therewith. The pivotal connections 86 provided on the shelves 18, 20, 22 may be configured with a frictional resistance so that each shelf 18, 20, 22 will not freefall by gravity when being pivotally moved.

Figure 6:
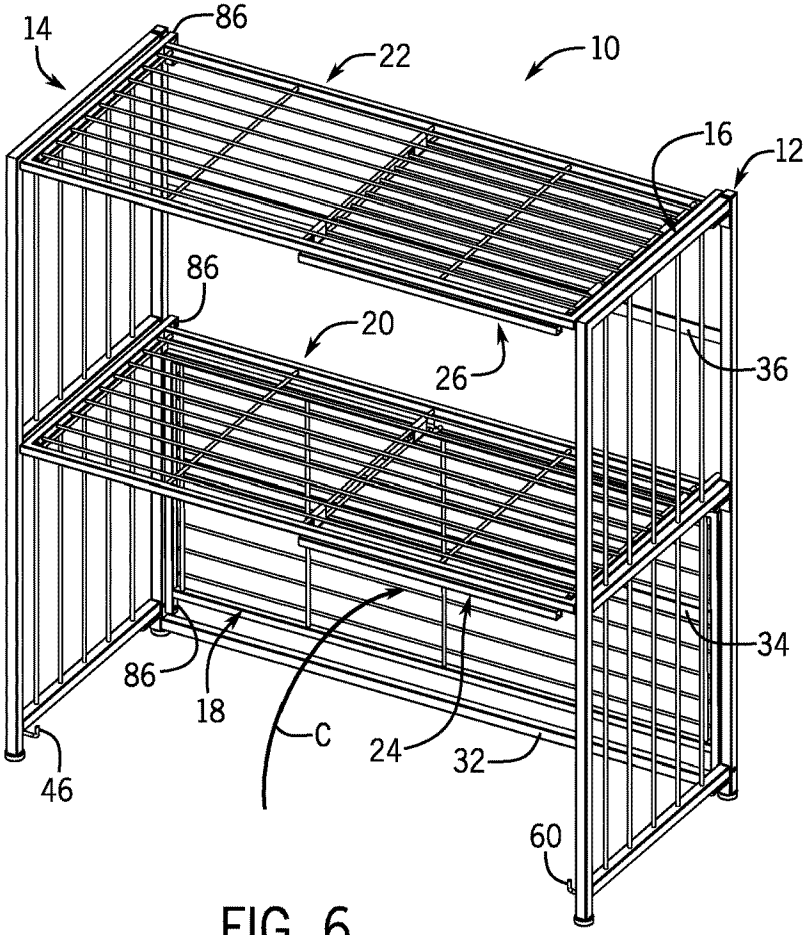
FIGS. 5-11 are sequential front perspective views of further stages of the shelving unit being folded towards the collapsed condition.

Each of the dividers 24, 26 is configured to be pivotally moved between a vertical position (e.g. FIG. 1) and a horizontal raised position (e.g. FIGS. 5 and 6). In their vertical positions, the dividers 24, 26 are used to define a plurality of separate storage spaces or "cubes", such as the four storage spaces created in the exemplary embodiment. Each of the dividers 24, 26 has an identical construction, and includes a front tube 88, a rear tube 90 and a pair of opposed wire connecting rods 92, 94 extending between the front and rear tubes 88, 90, such as seen in the divider 24 shown in its horizontal position in FIG. 3. A number of wire members 96 are connected between the wire connecting rods 92, 94. Each of the dividers 24, 26 is provided with a set of four releasable C-shaped retainer clips 98, 100, 102, 104 (FIGS. 3 and 4) which are pivotally mounted to the shelves 18, 20, 22 to hold the dividers 24, 26 in their vertical positions between shelves 18 and 20 and shelves 20 and 22, and in their horizontal positions coupled beneath one side of the shelves 20 and 22.

Figure 3:
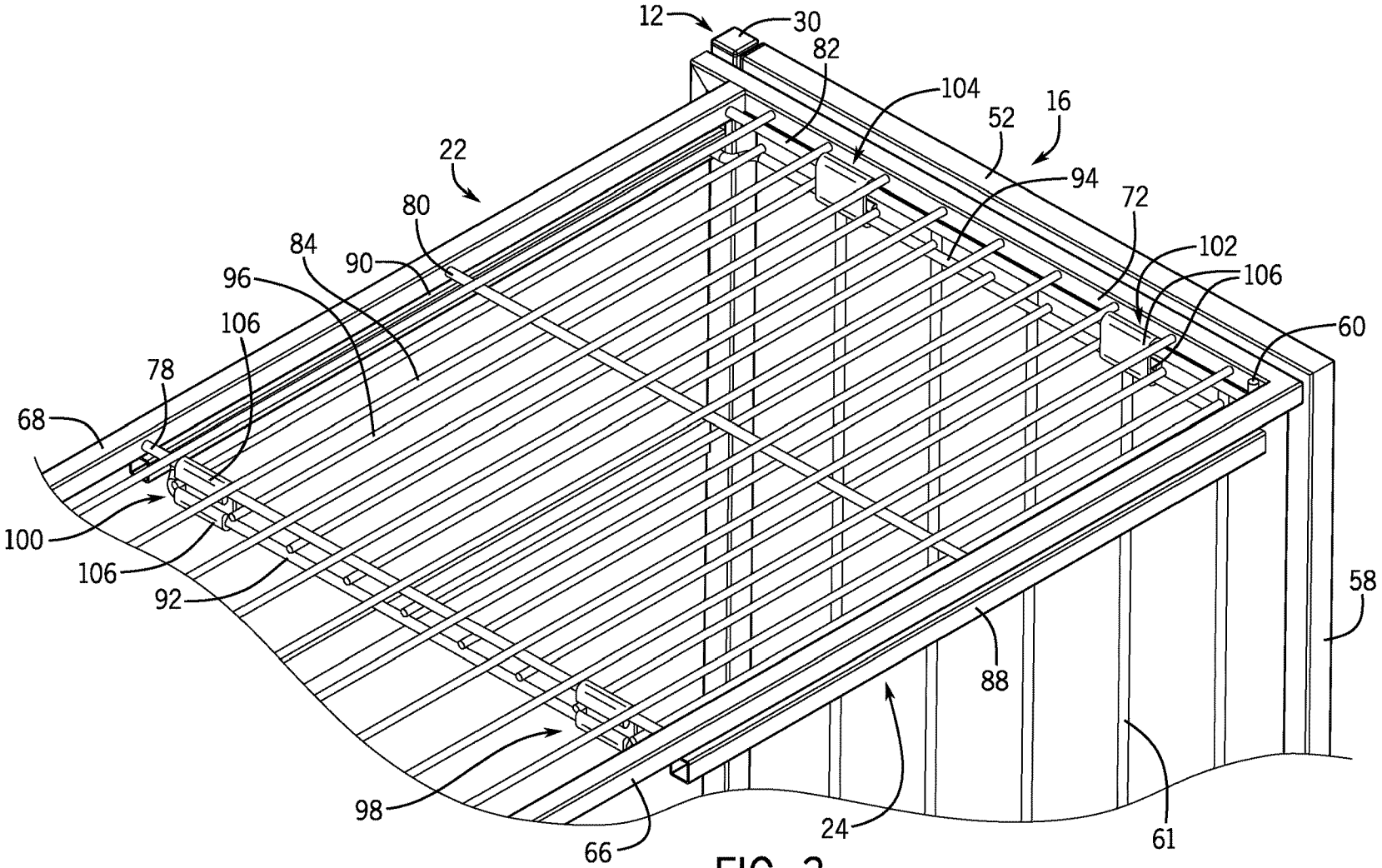
FIG. 3 is an enlarged detail view of an upper portion of FIG. 2.

Each of the C-shaped clips 98, 100, 102, 104 has a pair of curled portions 106 which are variously engageable and disengageable with wire support rods 78, 82 on the shelves 18, 20, 22 and with wire connecting rods 92, 94 on the dividers 24, 26. For example, as seen in FIG. 3 with the divider 24 pivoted to the horizontal position beneath the right side of shelf 22, ones of the curled portions 106 of the clips 98, 100 are pivotally engaged about the wire connecting rod 92, while the others of the curled portions 106 of the clips 98, 100 are clipped onto the wire supporting rod 78 of the shelf 22. Ones of the curled portions 106 of the clips 102, 104 meanwhile are pivotally engaged about the wire connecting rod 94 of the divider 24 while others of the curled portions 106 of the clips 102, 104 are pivotally engaged about the wire support rod 82 of the shelf 22.

In a further example with the divider 26 in a vertical position as shown in FIG. 4, ones of the curled portions 106 of the clips 98, 100 remain pivotally engaged about the wire connecting rod 92, while the others of the curled portions 106 remain clipped onto the wire support rod 78 of shelf 20. With the divider 24 in the vertical position, ones of the curled portions 106 of the clips 102, 104 are pivotally engaged about the wire support rods 78 of shelf 20, and others of the curled portions 106 of the clips 102, 104 remain pivotally engaged about the wire connecting rod 94 of the divider 24.

FIG. 1 illustrates the shelving unit 10 in a shelf-supporting condition such that the shelves 18, 20, 22 in their horizontal portions are held by hooks 46, 60, and the dividers 24, 26 are maintained in their vertical positions by the clips 98, 100, 102, 104 so that four internal storage areas are provided. Items may be supported on the shelves 18, 20 on opposite sides of the dividers 24, 26 as well as upon the shelf 22. The left side support frame 14 and the right side support frame 16 extend forwardly in substantially parallel relationship from the rear support frame 12. Engagement of the hooks 46, 60 with the shelves 18, 20, 22 prevents any pivotal movement of the left and right side support frames 14, 16. Bottom ends of the vertical members 28, 30, 44, 58 may be equipped with adjustable feet.

When it is desired to convert the shelving unit 10 from a shelf-supporting condition to a collapsed condition, the divider 24 is pivoted upwardly about wire rod 78 of shelf 22 in the direction of arrow A in FIG. 2 beneath the right side of shelf 22 by manually releasing the clips 102, 104 from the shelf 20 and reengaging the clips 102, 104 with the wire support rod 82 as shown in FIG. 3. The divider 26 is similarly pivoted upwardly about the wire support rod 78 of shelf 20 in the direction of arrow B in FIG. 5 beneath the right side of shelf 20 by manually releasing the clips 102, 104 from the shelf 18, and reengaging the clips 102, 104 with the wire support rod 82 of shelf 20 as shown in FIG. 5. Then, the shelf 18 is pivoted upwardly to a raised position in the direction of arrow C as shown in FIG. 6. The shelf 20 along with the divider 26 in its folded horizontal position is also pivoted upwardly in the direction of arrow D in FIG. 7.

Figure 8:
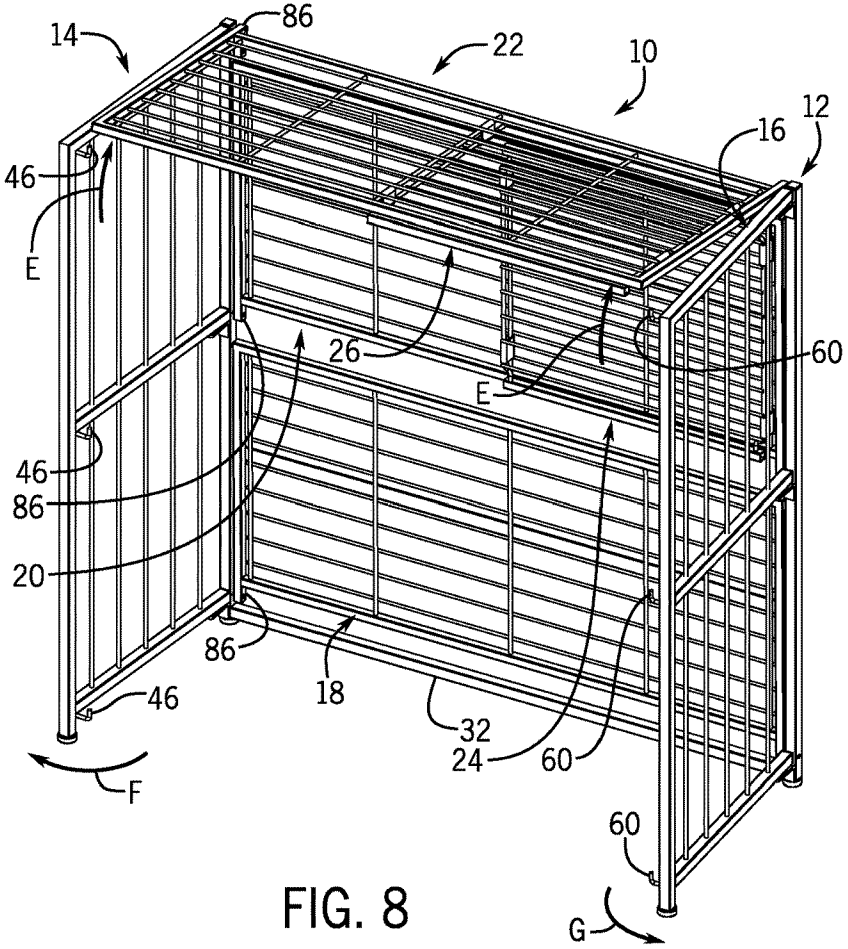
Figure 7:
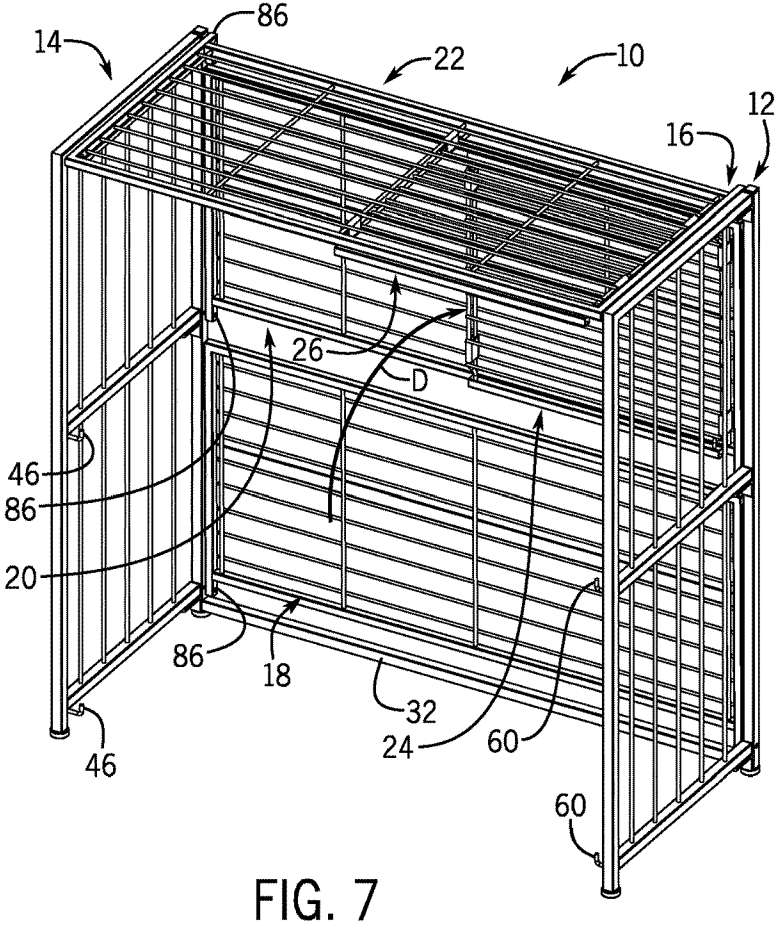
Figure 9:
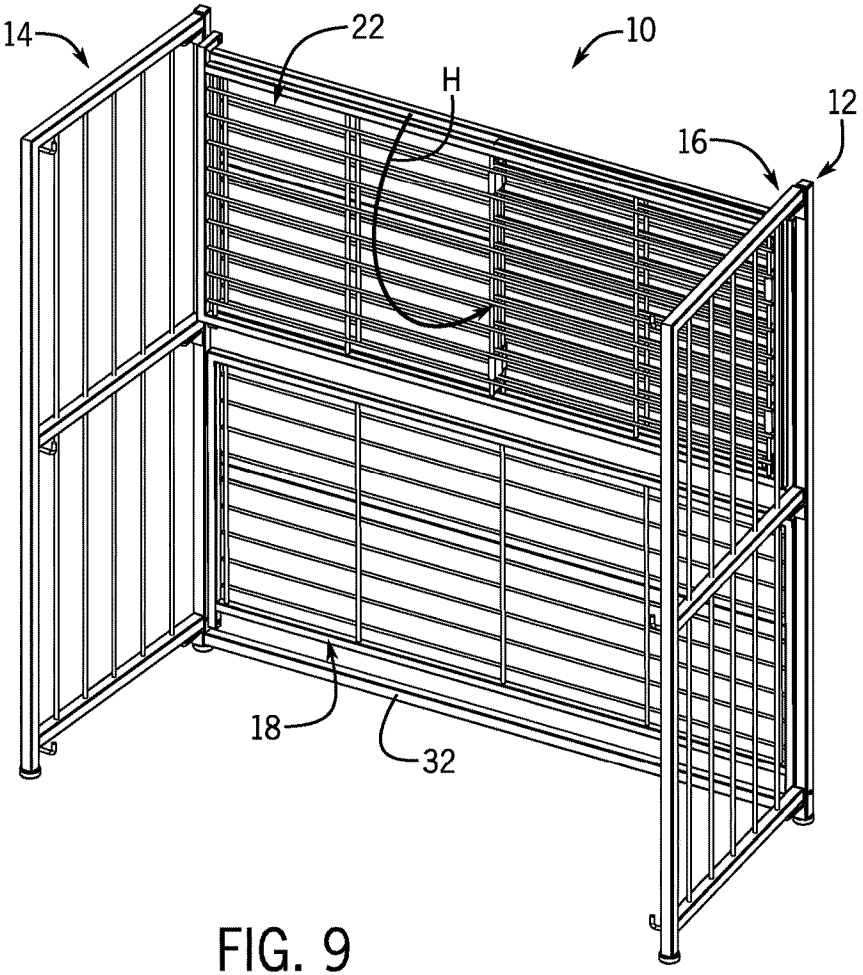
Figure 11:
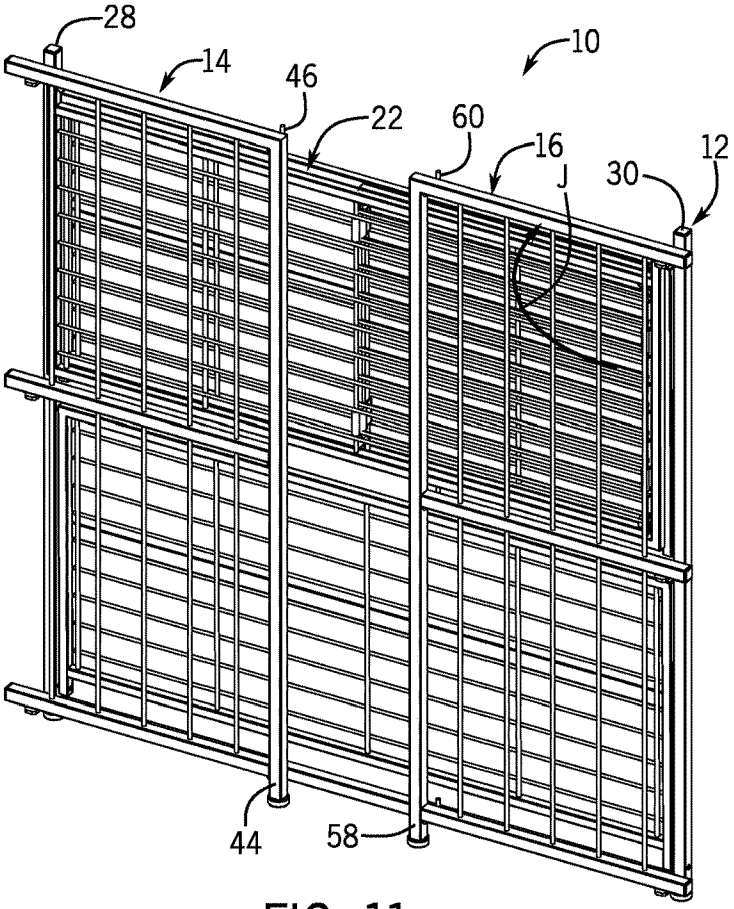

Once this is done, pivoting the shelf 22 slightly upwardly in the direction of arrows E and pivoting the left side support frame 14 and the right side support frame 16 in the direction of arrows F and G as shown in FIG. 8 so that they are in a diverging relationship moves the hooks 46, 60 outwardly. This provides an obstruction free path through which the shelf 22 along with the divider 26 folded in its horizontal position is moved during downward pivoting thereof in the direction of arrow H to the lowered vertical position lying forwardly of the raised shelf 20 and with folded divider 26 against folded divider 24 as shown in FIG. 9. At this point, the left side support frame 14 is pivoted inwardly in the direction of arrow I as shown in FIG. 10 so that it is parallel to and lies forwardly of the raised shelf 18 and the lowered shelf 22. Finally, the right side support frame 16 is pivoted inwardly in the direction of arrow J as shown in FIG. 11 so that it is opposite the left side support frame 14 and lies against and forwardly of the lowered shelf 22 as well the raised shelf 18 to attain the collapsed condition of the shelving unit further shown in FIG. 12.

The shelving unit 10 in the collapsed condition provides a compact, folded layered arrangement of the rear support frame 12, the shelf 20, the divider 24, the shelf 22, the left side support frame 14 and the right side support frame 16 which is conducive to easy transport and storage. The clips 98, 100, 102, 104 enable convenient repositioning of the dividers 24, 26. It should also be appreciated that the shelving unit 10 can be quickly and easily set up in the shelf-supporting condition with several simple unfolding steps and without the need for any tools or fasteners.

In the present disclosure, certain terms have been used for brevity, clearness and understanding. No unnecessary limitations are to be implied therefrom beyond the requirement of the prior art because such terms are used for descriptive purposes only and are intended to be broadly construed. The different configurations, systems and method steps described herein may be used alone or in combination with other configurations, systems and method steps. It is to be expected that various equivalents, alternatives and modifications are possible within the scope of the appended claims.

What is claimed is:

1. A shelving unit comprising:

a rear support frame having a pair of vertical side members, and a set of horizontal members extending between the vertical side members;

a first side support frame pivotally connected to one of the vertical side members of the rear support frame;

a second side support frame pivotally connected to the other of the vertical side members of the rear support frame;

at least two shelves, each being pivotally connected to the rear support frame for movement between a horizontal position supported upon the first and second side support frames, and a vertical position removed from the first and second side support frames;

at least one divider being pivotally mounted to one of the at least two shelves for movement between a first position extending between the at least two shelves, and a second position folded against the one of the at least two shelves, the at least one divider being movable in the second position thereof with the one of the at least two shelves to the vertical position thereof;

one of the first and second side support frames being pivoted between a first position extending forwardly from the rear support frame, and a second position folded forwardly of the rear support frame and the at least two shelves in the vertical position thereof; and the other of the first and second side support frames being pivoted between a first position extending forwardly from the rear support frame, and a second position folded forwardly of the rear support frame and the at least two shelves in the vertical position thereof and the at least one divider in the second position thereof.

2. The shelving unit of claim 1, wherein the first side support frame has a front vertical member and a number of horizontal members which are pivotally connected to one of the vertical side members of the rear support frame by a first pivotal connection.

3. The shelving unit of claim 2, wherein the second side support frame has a front vertical member and a number of horizontal members pivotally connected to the other of the vertical side members by a second pivotal connection.

4. The shelving unit of claim 3, wherein each of the first and second pivotal connections includes an L-shaped support bracket.

5. The shelving unit of claim 1, wherein the first side support frame has a first shelf-supporting structure thereon, and the second side support frame has a second shelf-supporting structure thereon, the first and second shelf-supporting structures being engaged with the at least two shelves in the horizontal position thereof.

6. The shelving unit of claim 1, wherein the at least two shelves includes a first shelf which in a vertical position, is received between the vertical side members of the rear support frame.

7. The shelving unit of claim 6, wherein the at least two shelves includes a second shelf which in a vertical position thereof is received between the vertical side members of the rear support frame and above the first shelf in the vertical position thereof.

8. The shelving unit of claim 7, wherein the first shelf and the second shelf in the vertical positions thereof are prevented from travel behind the rear support frame by the horizontal members thereof.

9. The shelving unit of claim 8, wherein the at least two shelves include a third shelf which in a vertical position thereof is folded downwardly and forwardly of the rear support frame and the first and second shelves in the vertical positions thereof.

10. The shelving unit of claim 1, wherein each of the at least two shelves is pivotally mounted about separate horizontal axes.

11. The shelving unit of claim 3, wherein the front vertical members of the first and second side support frames are provided with hooks which are engaged with the at least two shelves.

12. The shelving unit of claim 1, wherein the at least one divider includes a front rail and a rear rail which are joined together by a pair of connecting members.

13. The shelving unit of claim 12, wherein a connecting structure extends between the connecting members.

14. The shelving unit of claim 13, wherein the connecting members and the connecting structure are formed by wire rods.

15. The shelving unit of claim 1, wherein, in the second position, the at least one divider is folded beneath the one of the at least two shelves.

16. A shelving unit comprising:

a rear support frame having a pair of vertical side members, and a set of horizontal members extending between the vertical side members;

a first side support frame pivotally connected to one of the vertical side members of the rear support frame;

a second side support frame pivotally connected to the other of the vertical side members of the rear support frame;

at least two shelves, each being pivotally mounted to the rear support frame for movement between a horizontal position supported upon the first and second side support frames, and a vertical position removed from the first and second side support frames;

at least two shelves, each being pivotally connected to the rear support frame for movement between a horizontal position supported upon the first and second side support frames, and a vertical position removed from the first and second side support frames;

at least one divider being pivotally mounted to one of the at least two shelves for movement between a first position extending between the at least two shelves, and a second position folded against the one of the at least two shelves, the at least one divider being movable in the second position thereof with the one of the at least two shelves to the vertical position thereof;

one of the first and second side support frames being pivoted between a first position extending forwardly from the rear support frame, and a second position folded forwardly of the rear support frame and the at least two shelves in the vertical position thereof; and the other of the first and second side support frames being pivoted between a first position extending forwardly from the rear support frame, and a second position folded forwardly of the rear support frame and the at least two shelves in the vertical position thereof and the at least one divider in the second position thereof, wherein the at least one divider includes a movable clip arrangement configured for engagement and disengagement with the at least one of the at least two shelves.

17. The shelving unit of claim 16, wherein the movable clip arrangement is configured for engagement and disengagement with both of the at least two shelves.

18. The shelving unit of claim 16, wherein the clip arrangement includes a plurality of C-shaped clips, each of which has a pair of curled portions.

19. The shelving unit of claim 18, wherein a first one of the pair of curled portions is engaged with a portion of the at least one of the two shelves, and a second one of the pair of curled portions is engaged with a portion of the at least one divider.

20. A shelving unit comprising:

a rear support frame having a pair of vertical side members, and a set of horizontal members extending between the vertical side members;

a first side support frame pivotally connected to one of the vertical side members of the rear support frame, and provided with a first shelf-supporting structure;

a second side support frame pivotally connected to the other of the vertical side members of the rear support frame, and provided with a second shelf-supporting structure;

a first shelf pivotally mounted between the vertical side members for movement between a horizontal position supported on the first and second shelf-supporting structure, and a vertical position removed from the first and second shelf-supporting structure, and received between the vertical side members;

a second shelf pivotally mounted between the vertical side members for movement between a horizontal position supported on the first and second shelf-supporting structure above the first shelf in the horizontal position thereof, and a vertical position removed from the first and second shelf-supporting structure, and received between the vertical side members;

a third shelf pivotally connected between the vertical side members for movement between a horizontal position supported on the first and second shelf-supporting structure above the second shelf in the horizontal position thereof, and a vertical position removed from the first and second shelf-supporting structure, and positioned forwardly of and against the second shelf in the vertical position thereof;

a first divider being pivotally mounted to the second shelf for movement between a first position extending between the first and second shelves, and a second position folded against the second shelf, the first divider being movable in the second position thereof with the second shelf to the vertical position thereof;

a second divider being pivotally mounted to the third shelf for movement between a first position extending between the second and third shelves, and a second position folded against the third shelf, the second divider being movable in the second position thereof with the third shelf to the vertical position thereof;

one of the first and second side support frames being pivoted between a first position extending forwardly from the rear support frame, and a second position folded forwardly of the rear support frame and the first, second and third shelves in the vertical position thereof; and the other of the first and second side support frames being pivoted between a first position extending forwardly from the rear support frame, and a second position folded forwardly of the rear support frame, the first, second and third shelves in the vertical position thereof, and the first and second dividers in the second positions thereof.

* * * * *